US006126348A

United States Patent [19]

White et al.

[11] Patent Number: 6,126,348

[45] Date of Patent: Oct. 3, 2000

[54] POWER SUPPLY SYSTEM AND ASSEMBLY FOR A PORTABLE ELECTRONIC PRINTER

[75] Inventors: Ryan R. White, Coralville; Richard A. Sherman, Toddville; Mark W. Kubovich, Johnson, all of Iowa

[73] Assignee: Intermec IP Corp., Woodland Hill, Calif.

[21] Appl. No.: 09/288,983

[22] Filed: Apr. 9, 1999

Related U.S. Application Data

[60] Provisional application No. 60/081,412, Apr. 10, 1998, provisional application No. 60/081,372, Apr. 10, 1998, provisional application No. 60/081,381, Apr. 10, 1998, and provisional application No. 60/081,435, Apr. 10, 1998.

[51] Int. Cl.[7] ..... B41J 3/39

[52] U.S. Cl. ..... 400/691; 400/693; 400/685

[58] Field of Search ..... 400/691, 692, 400/693, 685, 680, 679, 88; 361/680; 439/501, 528

[56] References Cited

U.S. PATENT DOCUMENTS 5,180,232 1/1993 Chardima, Jr. et al. ..... 400/691 X
5,186,558 2/1993 Sherman et al. ..... 400/692
5,209,583 5/1993 Lewis et al. ..... 400/88
5,526,229 6/1996 Wakabayashi et al. ..... 361/702
5,906,506 5/1999 Chang et al. ..... 439/501 X

*Primary Examiner*—John S. Hilten
*Assistant Examiner*—Minh H. Chau

[57] ABSTRACT

A portable electronic printing system including power supply assembly is disclosed. The printing system includes a printer comprising a printer housing having first and second ends, a handle disposed at the first end of the housing for allowing a user to tote the portable electronic printing system, and a power supply foot disposed at the second end of the housing. The power supply foot includes a power supply circuit for supplying power received from an external power source to the printing system. The power supply assembly includes a sidewall and a bracket for supporting a first electronic device and for sinking heat generated by the first electronic device away from the first electronic device. The bracket is coupled to the sidewall such that heat received by the bracket from the first electronic device is transferred to the sidewall. A second electronic device is mounted to the bracket such that the bracket absorbs vibrational energy applied to the second electronic device.

13 Claims, 10 Drawing Sheets

POWER SUPPLY SYSTEM AND ASSEMBLY FOR A PORTABLE ELECTRONIC PRINTER

CROSS REFERENCE TO RELATED APPLICATIONS

This application claims priority under 35 U.S.C. 119 to the following U.S. provisional patent applications:

Provisional Application No. 60/081,412, filed Apr. 10, 1998,

Provisional Application No. 60/081,372, filed Apr. 10, 1998,

Provisional Application No. 60/081,381, filed Apr. 10, 1998, and

Provisional Application No. 60/081,435, filed Apr. 10, 1998.

The above identified applications are all hereby incorporated by reference herein in their entireties. The two microfiche appendices of Provisional Application No. 60/084,435 are also hereby incorporated herein by reference in their entireties.

FIELD OF THE INVENTION

The present invention generally relates to the field of portable electronic printers, and particularly to an electronic printer for utilization with a portable hand-held computer.

BACKGROUND OF THE INVENTION

Portable hand-held computers are typically utilized for data collection and management in the modern computerized business world. For example, commercial transactions for the sale of goods may be stored in a portable hand-held computer that is carried by delivery personnel to a customer's place of business. After the delivery driver enters execution of the transaction into the hand-held computer, an invoice verifying the date, time and contents of the delivery is desired. The invoice may be conveniently printed with a portable printer to which the delivery driver may connect the hand-held computer.

The usefulness of portable printers has been enhanced by efforts in reducing the size and modularity of printers when compared to their respective forerunners. Also, minimization of tasks may further the utility of portable printers by route service people in operating the printers.

Furthermore, it is highly desirable that a portable printing system is adaptable to a variety of environments. Thus, a printer may be mounted in a vehicle in which case it may receive dc power from the power system of the vehicle. Alternatively, it may be desirable to adapt that same printer for portable use wherein the printing system is carried by hand to an interior location such as a warehouse or store in which case it is desirable for the printer to operate from ac power.

SUMMARY OF THE INVENTION

The present invention is directed to a portable electronic printing system. In one embodiment the portable electronic printing system includes a printer comprising a printer housing having first and second ends, a handle disposed at the first end of the housing for allowing a user to tote the portable electronic printing system, and a power supply foot disposed at the second end of the housing, the power supply foot including a power supply circuit for supplying power received from an external power source to the printing system.

The present invention is further directed to a power supply assembly for a portable electronic printer. In one embodiment, the power supply assembly includes a sidewall, a bracket for supporting a first electronic device and for sinking heat generated by the first electronic device away from the first electronic device, the bracket being coupled to the sidewall such that heat received by the bracket from the first electronic device is transferred to the sidewall, and a second electronic device mounted to the bracket such that vibrational energy applied to the second electronic device is absorbed by the bracket.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiment of the invention, an example of which is illustrated in the accompanying drawings.

Figure 1:
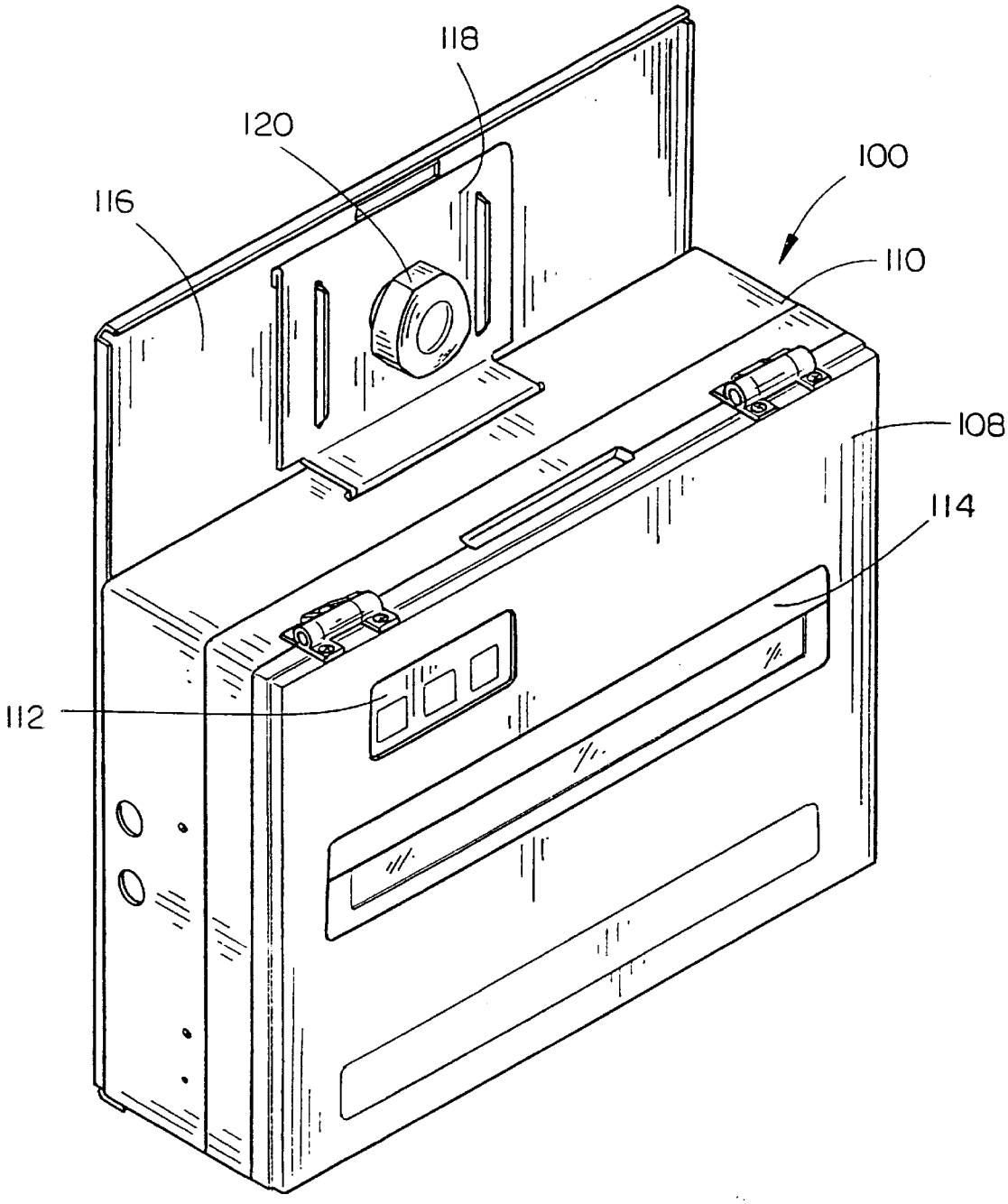
FIG. 1 is an illustration of a portable electronic printer in accordance with the present invention.

Referring now to FIG. 1, a portable electronic printer in accordance with the present invention will be discussed. The printer 100 comprises a printer housing 110 having a top cover 108 and a control keypad 112 and paper egress aperture 114 disposed on top cover 108. For mounting of printer 100 on a vertical surface such as a wall of a service vehicle, printer 100 may be affixed to a mounting plate 116. A mounting bracket 118 and mounting knob 120 robustly and securely fasten printer 100 to mounting plate 116 yet allow for rapid and simple removal or replacement of printer 100 by a user without requiring tools.

Figure 2:
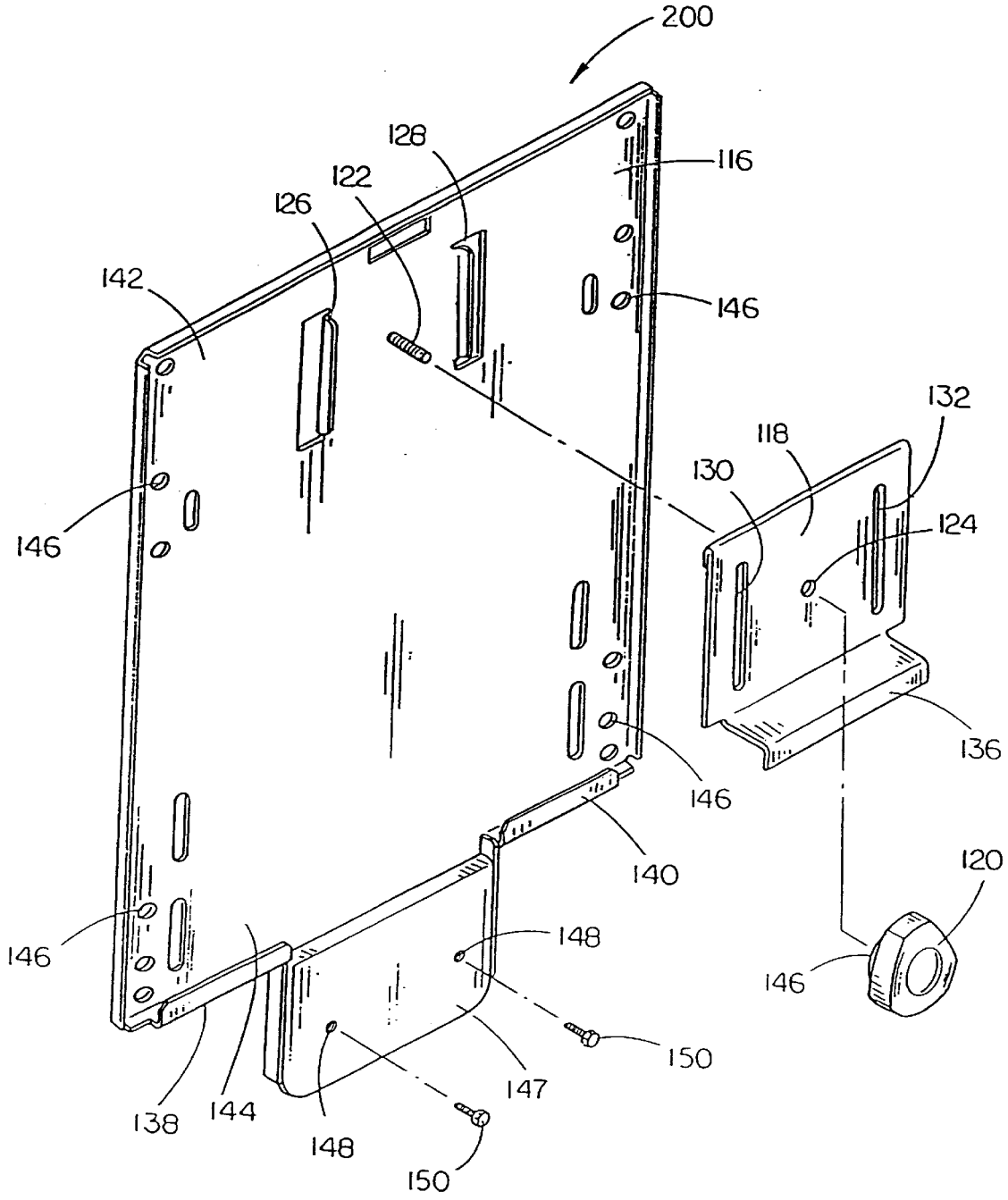
FIG. 2 is an illustration of a mounting system for the portable electronic printer of the present invention.

Referring now to FIG. 2, a mounting system for the portable electronic printer of the present invention is shown. Mounting system 200 generally comprises mounting plate 116, mounting bracket 118 and mounting knob as shown in FIG. 1. A threaded bolt 122 is cantileveredly disposed at the top end 142 of mounting plate 116. Threaded bolt 122 and mounting knob together function as a fastener for fastening mounting bracket 118 to mounting plate 116. Mounting bracket 118 has an aperture 124 for allowing passage of bolt 122 through aperture 124 in a clearance fit relationship. Mounting plate 116 further has tabs 126 and 128 extending perpendicularly from mounting bracket and adjacently disposed on either side of bolt 122. Mounting bracket includes linear slits 130 and 132 corresponding to tabs 126 and 128 which allow tabs 126 and 128 to pass therethrough as bolt 122 extends through aperture 124. The spatial positing and alignment of bolt 122, aperture 124, tabs 126 and 128, and slits 130 and 132 constrain the position of mounting bracket 118 with respect to mounting plate 116. Mounting knob 120 includes a threaded cavity 146 that corresponds to and mates with threaded bolt 122, thereby allowing mounting knob 120 to be threaded onto bolt 122 and securely fasten mounting bracket 118 against mounting plate 116.

Mounting plate 116 further includes an array of apertures 146 that allow mounting plate 116 to be securely mounted to a vertical support surface, e.g., bolted to a wall. Tabs 138 and 140 are disposed near the bottom end144 of mounting plate 116 and arranged parallel to plate 116. A mounting tab 147 is also disposed at the bottom 144 of mounting plate 116 for allowing a printer accessory such as a paper tray (not shown) to be mounted to mounting plate 116. Mounting tab 147 may include threaded cavities for accepting threaded bolts 150 in order to fasten an accessory to mounting tab 147.

Figure 3:
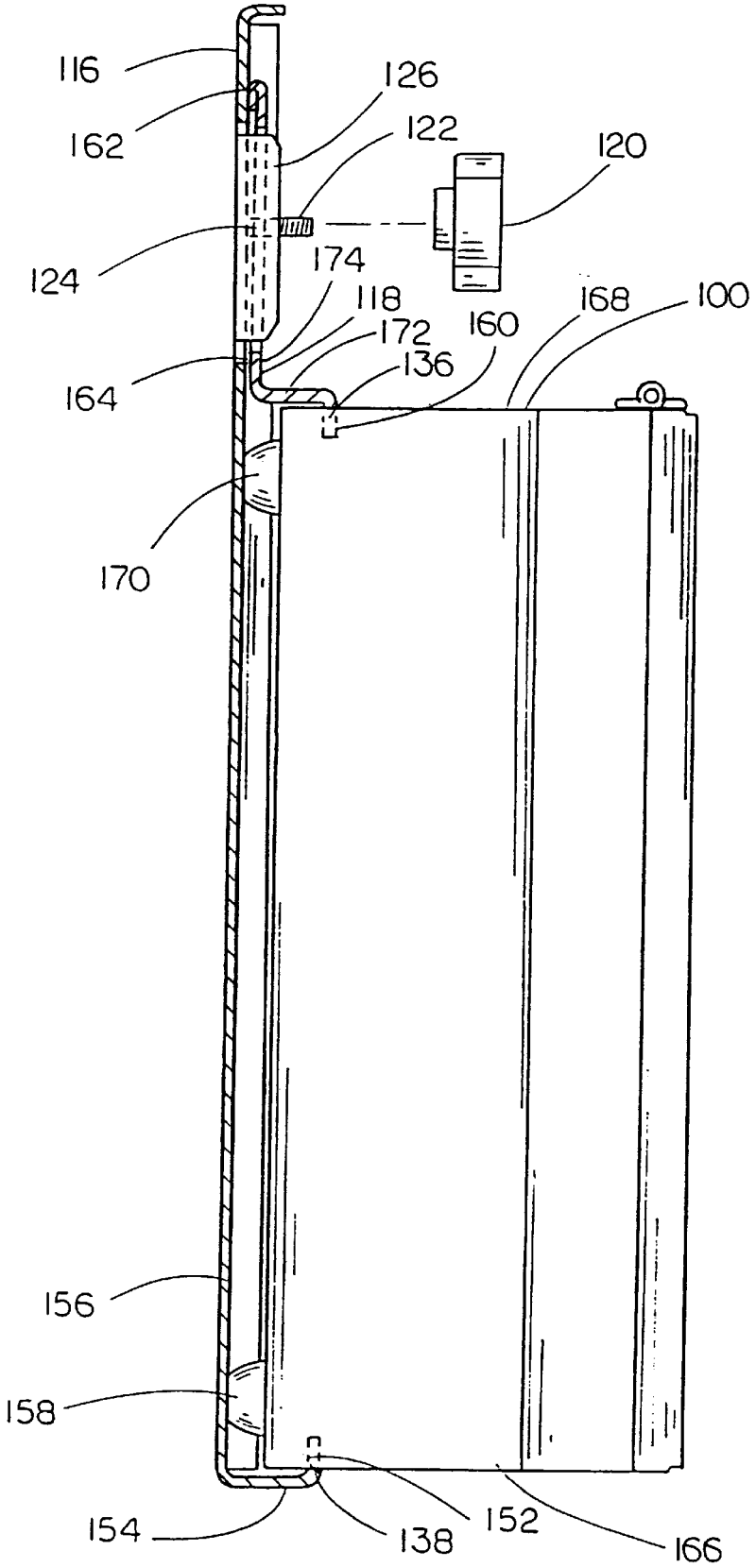
FIG. 3 is an illustration of a printer and printer mounting system of the present invention.

Referring now to FIG. 3, a printer and printer mounting system of the present invention will be discussed. Printer 100 includes a slot 152 disposed at the bottom side 166 of printer. When printer 100 is mounted onto mounting plate 116, tab 138 of mounting plate extends into slot 152 of printer 100. When mounting plate 116 is attached to a vertical support surface, printer 100 is supported by tab extension 154 of mounting plate 116. Tab 138 prevents movement of printer 100 in a direction perpendicular to mounting plate 116. Pinter foot 158 provides a spacing function for printer 100 by spacing slot 152 in alignment with tab 138 when printer foot 158 contacts the vertical surface 156 of plate 116. The size of foot 158, the length of tab extension, and the position of slot 152 are selected to allow such a relationship.

A slot 160 is similarly disposed at a top side 168 of printer 100 for allowing a tab 136 of bracket 118 to extend into slot 160 in a manner similar to the extension of tab 138 into slot 152 at the bottom side 166 of printer 100. Bracket 118 is affixed to plate 116 by allowing passage of bolt 122 and tab 126 through aperture 124 and slit 130, respectively. Bracket 118 includes a folded tab 162 as shown which contacts vertical surface 156 of plate 116. Printer foot 170 provides a spacing function for printer 100 in a manner similar to that provided by printer foot 158. Printer foot 170 spaces slot 160 in alignment with tab 136 when printer foot 170 contacts the vertical surface 156 of plate 116 when bracket 118 is disposed onto bolt 122. The size of foot 170, the thickness of folded tab 162, the length of tab extension 172 of bracket 118 and the position of slot 136 position the bottom end 174 of bracket 118 a distance away from vertical surface 156 of plate 116 when folded tab 162 contacts vertical surface 156 of plate 116 and tab 136 extends into slot 160 of printer 160 such that a gap 164 is formed between bottom end 174 of bracket 118 and vertical surface 156 of plate 116. Thus, bracket 118 functions as a lever wherein folded tab 162 functions as the fulcrum of the lever.

As mounting knob 120 is threaded onto bolt 122, knob 120 applies force to bracket 118. The force generated by the threading of knob 120 onto bracket 118 is transferred from bracket 118 to printer 100 at slot 160 via tab 136, thereby causing bracket 118 to pivot about the fulcrum point provided by folded tab 162, moving bottom end 174 of bracket 118 toward vertical surface 156 of plate 116 and causing gap 164 to diminish. Printer feet 158 and 170 provide resistance to the applied force through compression of feet 158 and 170 against vertical surface 156. Printer feet 158 and 170 preferably comprise a rugged, springy, compressible material such as rubber or buna having a compliance (where the compliance of a spring is the reciprocal of the force constant and is measured in meters per newton) selected to robustly secure printer 100 in contact with plate 166 and to provide shock absorption and transfer of energy applied to either plate 116 or printer 100. Printer is thereby ruggedly affixed to a vertical support surface to which mounting plate 116 is attached.

Figure 4:
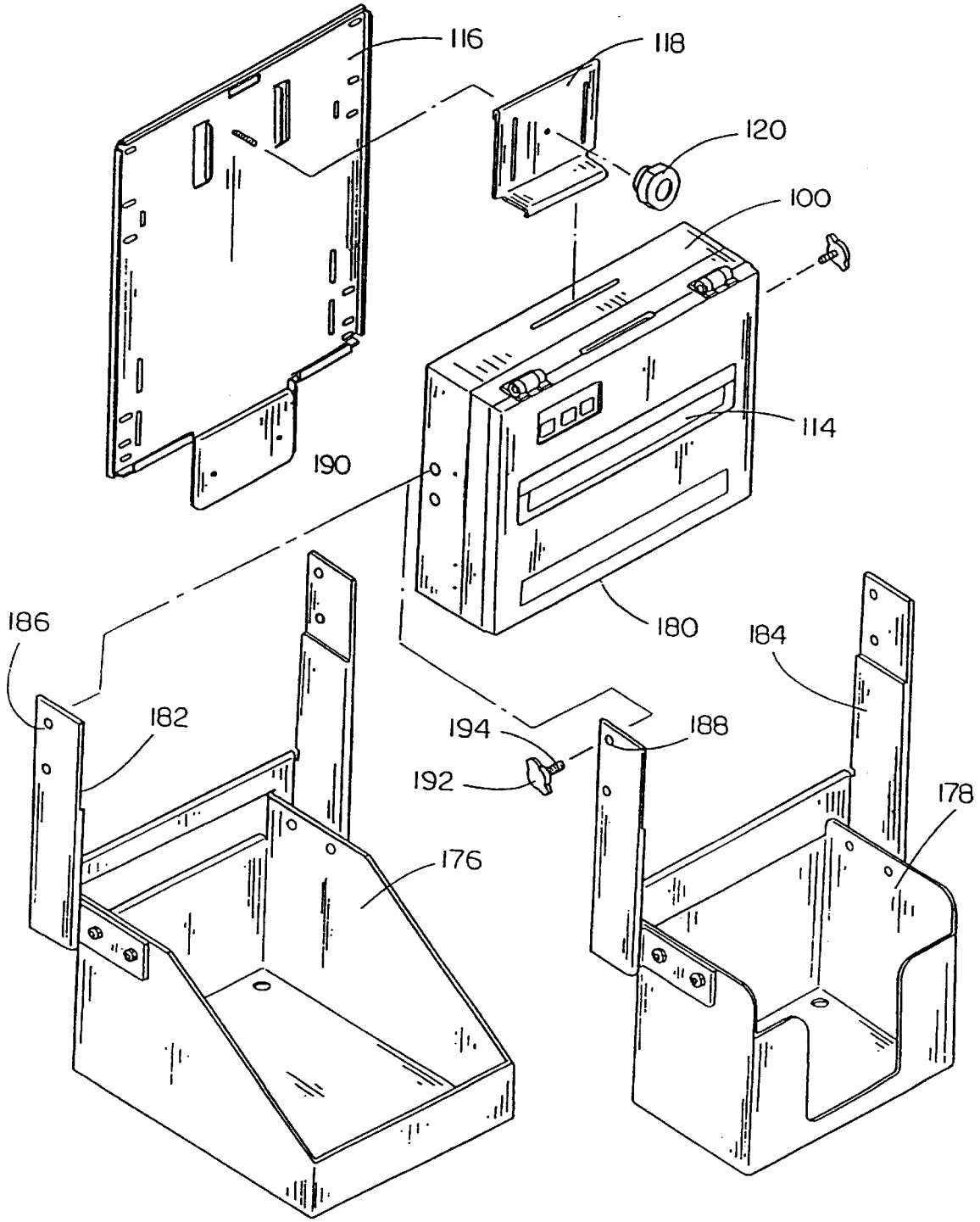
FIGS. 4 and 5 are illustrations of an assembly of a printing system in accordance with the present invention.
Figure 5:
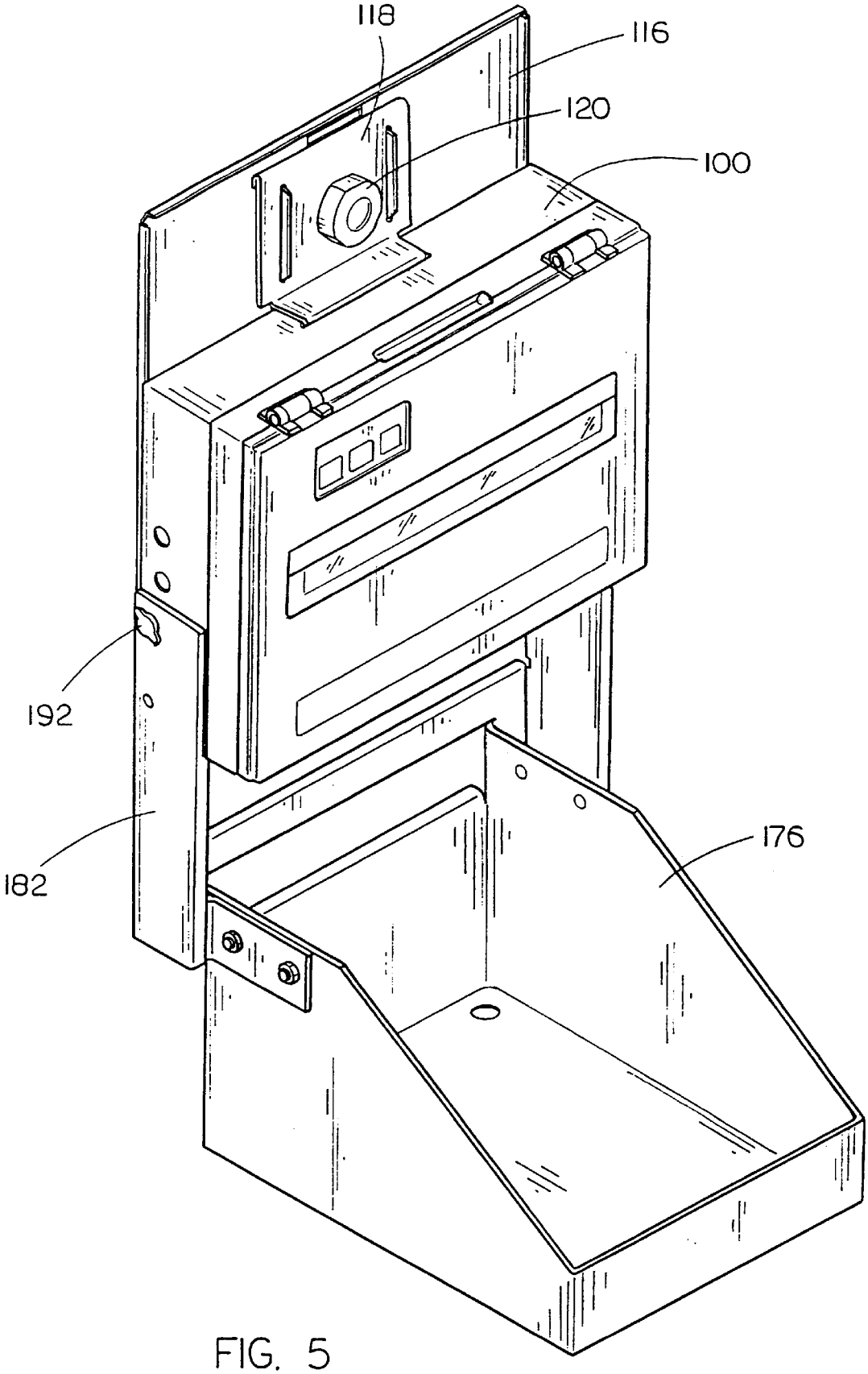

Referring now to FIGS. 4 and 5, an assembly of a printing system in accordance with the present invention will be discussed. As can be seen in FIG. 4, printer 100 may be quickly and easily attached to mounting plate 116 and secured thereto with mounting bracket 118 and mounting knob 120. Additionally, paper trays 176 and 178 may be attached to printer 100. Paper tray 176 may carry paper divided into elongated sections and paper tray 1787 may carry paper of shorter sections. Paper loaded in either paper tray 176 or 178 is typically continuous-form including perforations delineating each individual page such that an entire series of pages may be fed into printer 100 via a paper intake aperture and emitted from paper egress aperture 114, for example. Paper may be tractor or sprocket fed wherein rotatably mounted pins (not shown) in printer 100 engage with a row of holes disposed along either edge of the paper such that the paper is driven through printer 100 via movement of the pins.

Paper trays 176 and 178 include support brackets 182 and 184 each having apertures 186 and 188 corresponding to a threaded cavity 190 of printer 100. Apertures 186 and 188 align with cavity 190 to allow passage of a support bracket mounting knob 192 having a threaded bolt that passes through apertures 186 and 188 into cavity 190, thereby fastening either bracket 182 or 184 to printer 100 according to the selected paper tray. A completely assembled printer mounting system is shown in FIG. 5.

Figure 6:
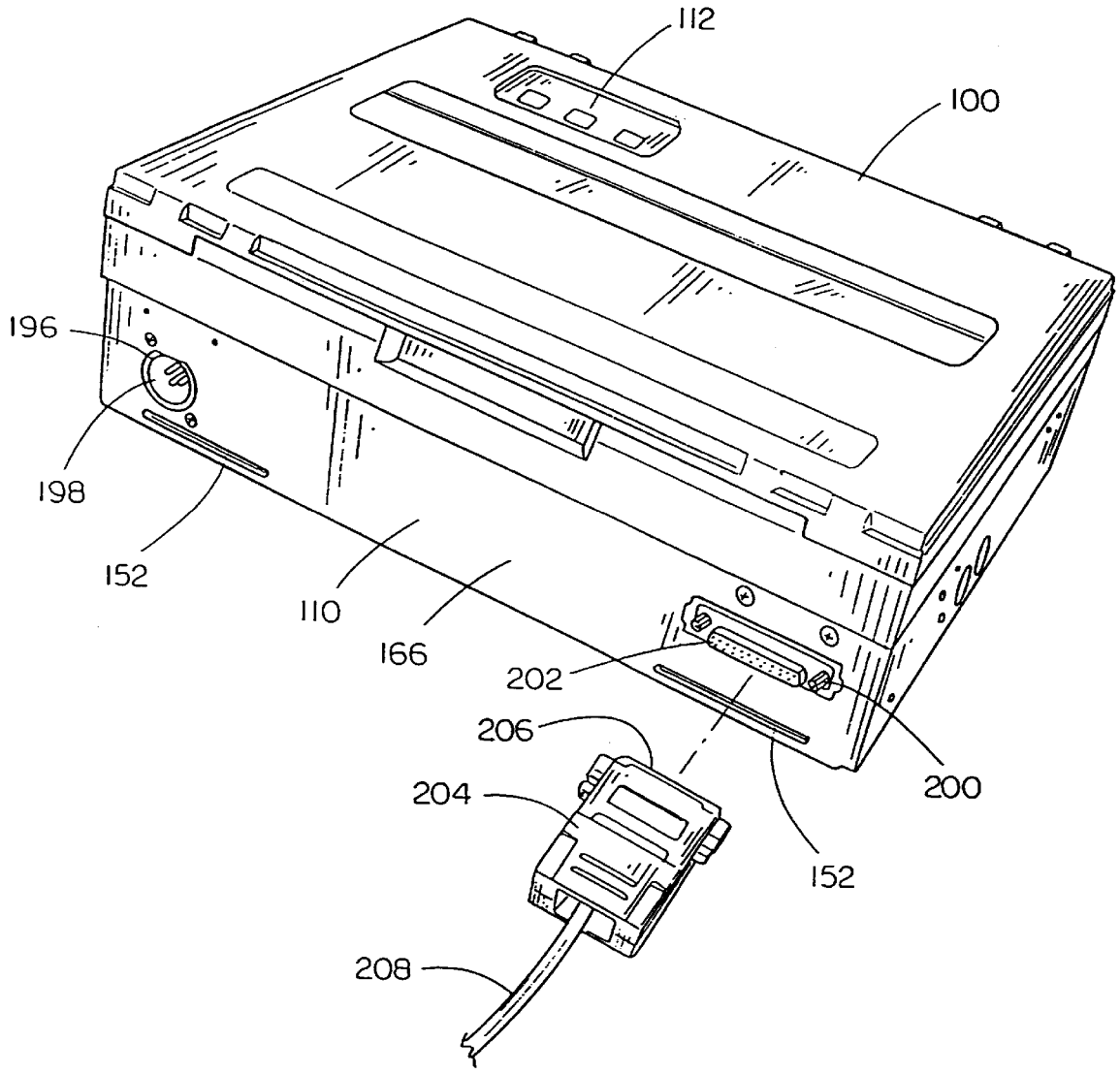
FIG. 6 is an illustration of a printer in accordance with the present invention.

Referring now to FIG. 6, a printer in accordance with the present invention will be discussed. Printer 100 includes a power adapter port 196 disposed at the bottom side 166 of printer 100 for connecting the printer to an external power source. The power source may be an ac or a dc power source, for example, wherein printer 100 conditions the signal appropriately into a form and level appropriate for powering the printer. Power may be received at one or more input pins 198 of port 196.

Printer 100 may further include a data port 200 for transferring information between printer 100 and an external device (not shown). Data port 200 may be a parallel port and include a female receptacle 202 for coupling with a male receptacle 206 of a connector 204 of a parallel port cable 208 such that data may be transferred between printer 100 and an external device. In one embodiment of printer 100, parallel port 200 is in compliance with a Centronics parallel interface standard, a standard for parallel data exchange between computers and peripheral devices such as printer 100. As can be seen in FIG. 6, printer 100 includes slots 152 for receiving tabs 138 and 140 as shown in FIGS. 2 and 3.

Figure 7:
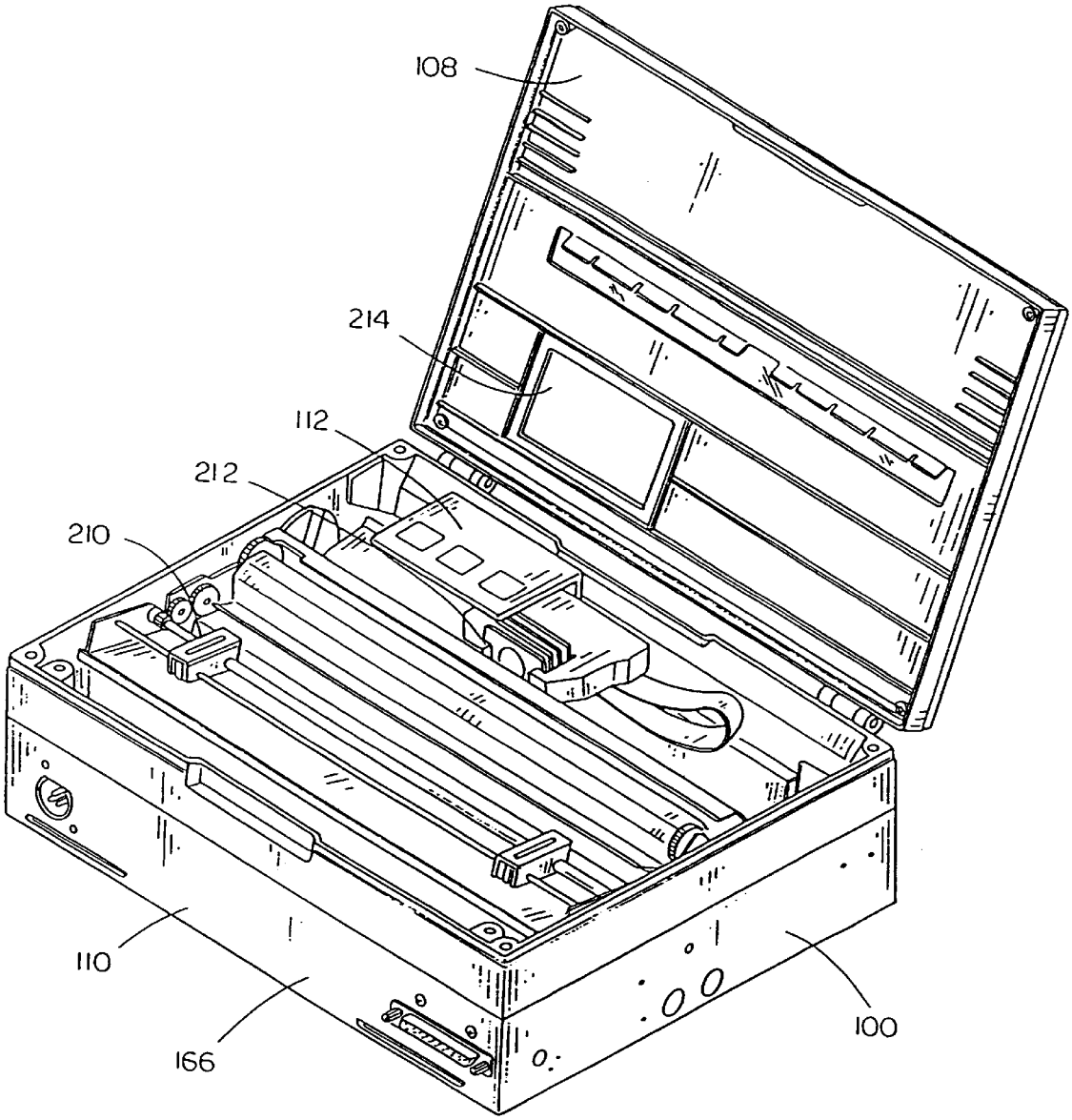
FIG. 7 is an illustration of the internal mechanisms of a printer of the present invention.

Referring now to FIG. 7, the internal mechanisms of a printer of the present invention will be discussed. Top cover 108 of printer 100 opens to expose the internal mechanisms of printer 100. A keypad aperture 214 is formed in top cover 108 to provide access and viewability of keypad and display 112 when top cover 108 is in a closed position. Printer 100 includes a paper feed mechanism for feeding paper through printer 100. As paper is fed through printer 100 with a paper feed mechanism 210, a printing mechanism 212 prints characters received as printing data sent to printer 100 via data port 200 onto the paper.

Figure 8:
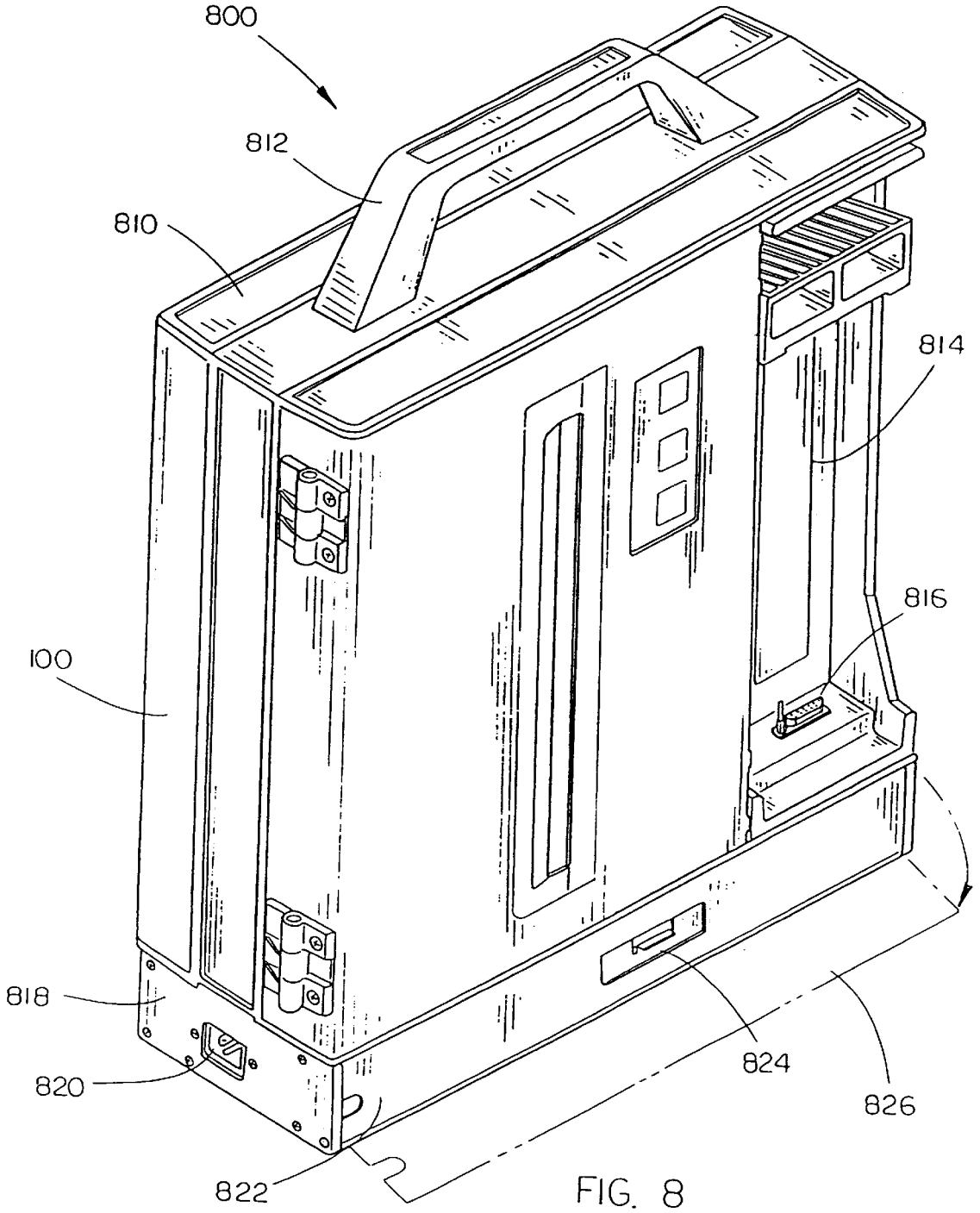
FIG. 8 is an illustration of a portable printing system in accordance with the present invention.
Figure 9:
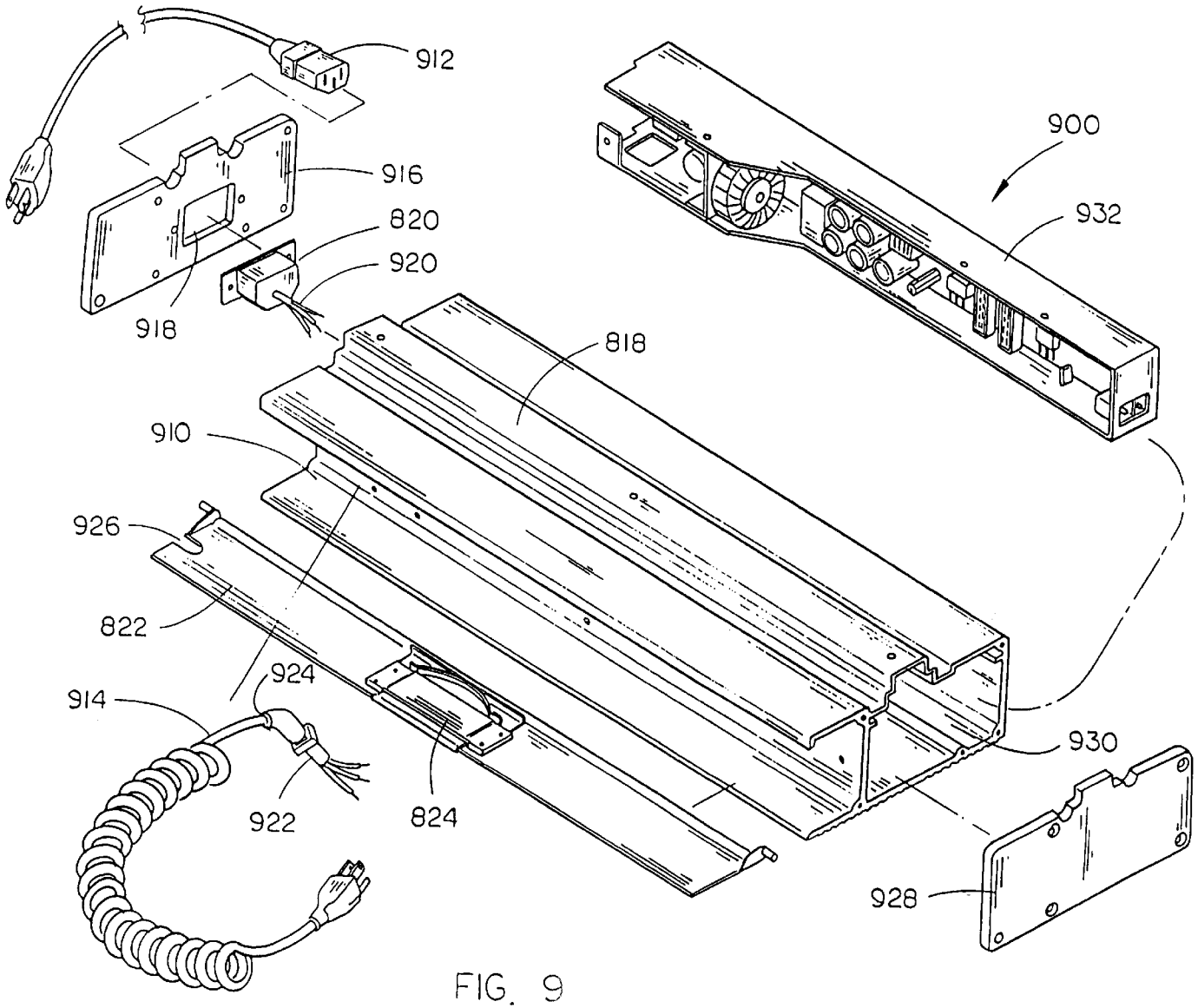
FIG. 9 is an illustration of a power supply foot assembly for a portable printing system in accordance with the present invention.

Referring now to FIG. 8, a portable printing system in accordance with the present invention will be discussed. The portable printing system 800 includes printer 100 of FIG. 1 and a frame 810 to which printer 100 is mounted for portable use thereof. Frame 810 includes a handle 812 at one end for allowing user to pick up and carry portable printing system 800. Frame 810 further includes a receptacle 814 for receiving a portable electronic data terminal (not shown) to be used in conjunction with printer 100. Receptacle 814 includes a connector 816 for electrically coupling the portable electronic data terminal with printer 100. A power supply foot 818 is attached at an end of frame 810 opposite to handle 812. Power supply foot 818 contains a power supply for supplying operating power to printer 100 and to a data terminal via connector 816 when the terminal is disposed in receptacle 814. Power supply foot 818 includes a power cord receptacle 820 for receiving an end of a power cable (as shown in FIG. 9) to connect printing system 800 to a power source such as a power outlet from a wall socket or from vehicle power. While printing system 800 is being transported during portable use, the power cable may be stowed in a compartment behind a cover 822 that opens upon actuation of cover latch 824 to an open position 826.

Referring now to FIG. 9, a power supply foot assembly for a portable printing system in accordance with the present invention will be discussed. The power supply foot assembly 900 includes a power supply foot 818 that preferably comprises a strong, durable and lightweight material having a relatively high thermal conductivity such as aluminum. Power supply foot 818 includes a first cavity 910 for stowing a power supply cord such as a non-coiled International Electrotechnical Commission (IEC) compliant cable 912 or a coiled cable 914, for example. An end plate 916 is disposed at one end of power supply foot 818 and includes an aperture for receiving IEC receptacle 820 having cabling 920 for connecting power to the power supply circuit 932 of power supply foot 818. Power supply cable may be temporarily removed from receptacle 820 for stowage in cavity 910. Power cable 914 may be permanently connected to power supply circuit 932 via cabling 922. When power cable 914 is connected to a power source, an aperture 926 in foot cover 822 allows power cable 914 to extend from power supply foot 818 with cable end 924 passing through aperture 926 while cover 822 is in a closed position. Power supply foot 818 includes a second cavity 930 for receiving power supply circuit 932. A second end plate 928 covers cavities 914 and 930 at the end of power supply foot 818 opposite to end plate 916.

Figure 10:
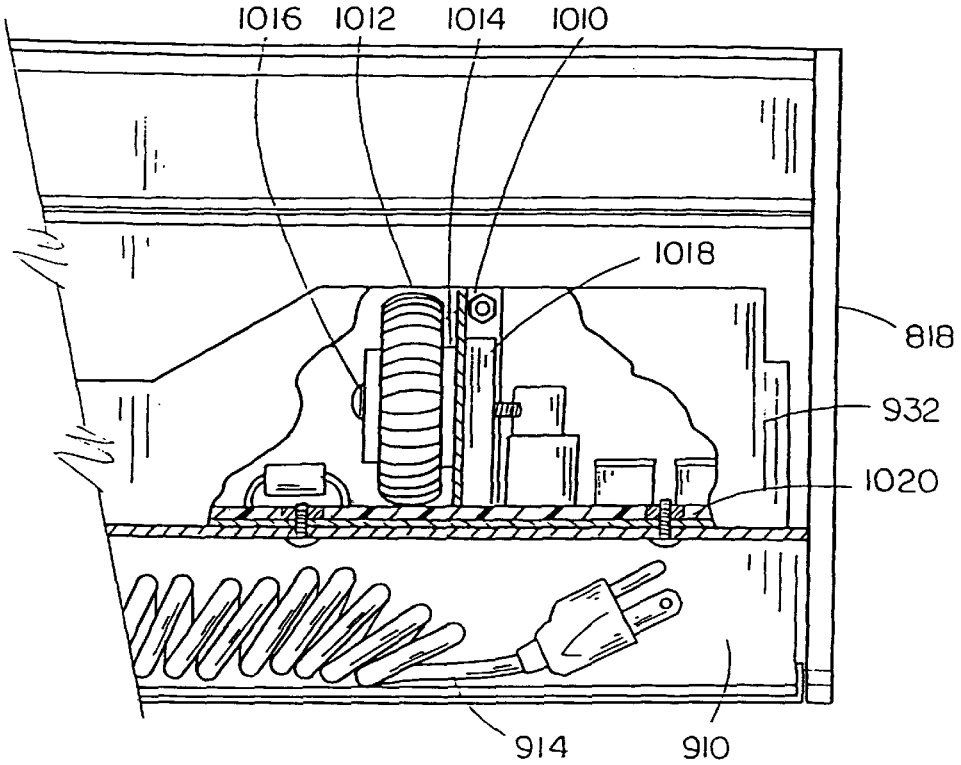
FIGS. 10 and 11 are illustrations of a power supply circuit assembly in accordance with the present invention.
Figure 11:
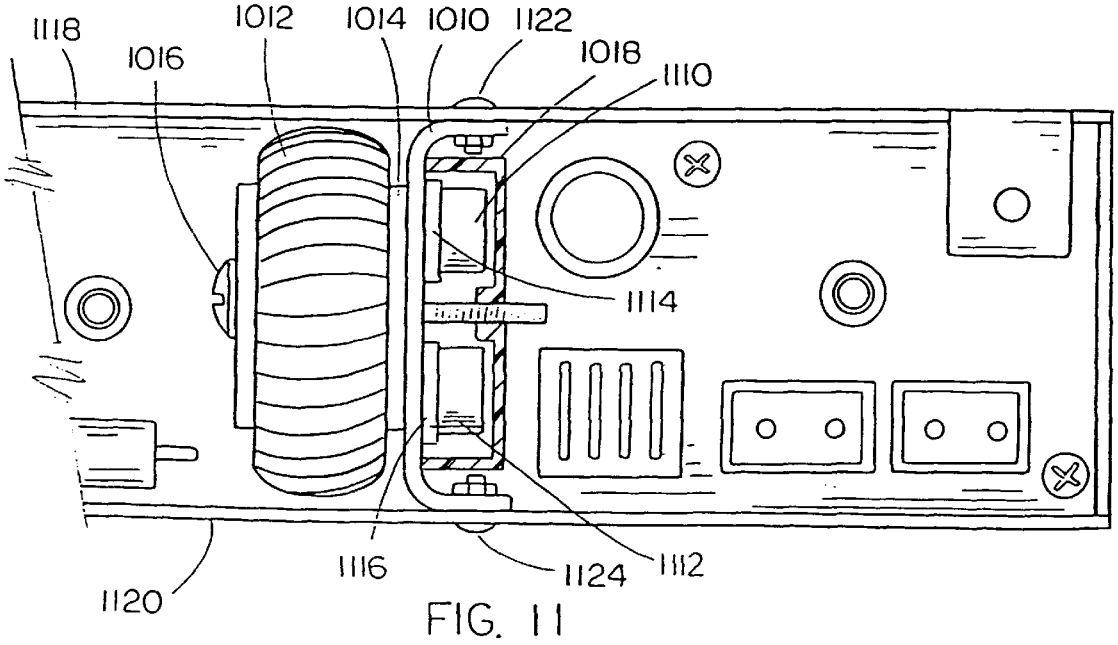

Referring now to FIGS. 10 and 11, a power supply circuit assembly in accordance with the present invention will be discussed. Power supply foot 818 includes a power supply circuit 932 mounted therein for conditioning power received from an external ac power source via cable 912 or cable 914. As shown in FIG. 10, cable 914 may be stowed in cavity 910 of power supply foot 818. Power supply circuit 932 includes a magnetic element that may be a toroidal inductor 1012 as shown. Inductor 1012 is bound one side by a spacer 1014. A fastener 1016 connects inductor 1012 and spacer 1014 to a mounting bracket 1010. Fastener 1016 further passes through and fastens a cover 1018 to bracket 1010 opposite to inductor 1012. Cover 1018 contains electronic components 1110 and 1112 which are power conditioning components that typically generate heat during use which should be dissipated, for example voltage regulators. Components 1110 and 1112 are in physical contact with bracket 1010 via silicone pads 1114 and 1116. Bracket 1010 is in turn mounted to sidewalls 1118 and 1120 of power supply circuit 932 via fasteners 1122 and 1124. Heat generated by components 1110 and 1112 is conducted through silicone pads 1114 and 1116 to bracket 1010. The heat received by bracket 1010 is further conducted to sidewalls 1118 and 1120.

The power supply circuit assembly as illustrated in FIGS. 10 and 11 provide several advantageous functions. Toroidal inductor 1012 is physically mounted to bracket 1010 rather than to circuit board 1020 thereby providing superior shock dampening and stabilization of inductor 1012. Bracket 1010 and sidewalls 1118 and 1120 form an enclosure around devices 1110 and 1112 thereby providing electrical isolation and shielding of devices 1110 and 1112. Cover 1018 assists in physically clamping devices 1110 and 1112 to bracket 1010 which also functions as a heat sink for devices 1110 and 1112. Additionally, bracket 1010 is in a sufficient physical contact with sidewalls 1118 and 1120 which also function as heat sinks thereby increasing the effective surface area of bracket 1010 for heat sinking purposes which improves the heat sinking effectiveness of the power supply circuit 932. The entire power supply assembly is easily assembled and requires only a single fastener 1016.

It is believed that the power supply system and assembly for a portable electronic printer of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A portable electronic printing system, comprising:

a printer comprising a printer housing having first and second ends;

a handle disposed at the first end of said housing for allowing a user to tote the portable electronic printing system; and a power supply foot assembly disposed at the second end of said housing, said power supply foot assembly including a power supply circuit for supplying power received from an external power source to said printing system, and said power supply foot assembly comprising:

a side wall; and a bracket for supporting an electronic device and for sinking heat generated from said electronic device away from said electronic device, said bracket being coupled to said sidewall such that heat received by said bracket from said electronic device is transferred to said sidewall.

2. A portable electronic printing system as claimed in claim 1, said power supply foot comprising an elongated rectangular housing having a cavity for stowing a power cord for connecting said power supply circuit to the external power source.

3. A portable electronic printing system as claimed in claim 2, said cavity having a hinged cover for covering said cavity.

4. A portable electronic printing system as claimed in claim 1, said power supply foot being adapted to function as a heat sink for said power supply circuit.

5. A portable electronic printing system as claimed in claim 1, said power supply foot being adapted to support the portable printing system in an upright position.

6. A portable electronic printing system as claimed in claim 1, said power supply foot comprising aluminum.

7. A portable electronic printing system as claimed in claim 1, said power supply foot including an IEC compliant connector for connecting an IEC compliant cord to the external power source.

8. A portable electronic printing system as claimed in claim 1, further comprising a receptacle for receiving a portable hand-held electronic device, and a connector disposed in said receptacle for coupling the portable hand-held electronic device to said printer.

9. The portable electronic printing system as in claim 1, wherein the electronic device is a first electronic device, said system further comprising a second electronic device mounted to said bracket such that vibrational energy applied to said second electronic device is absorbed by said bracket.

10. The portable electronic printing system as in claim 9, further comprising a cover for covering said first electronic device, wherein said second electronic device and said cover are fastened to said bracket with a fastener.

11. The portable electronic printing system as in claim 9, said second electronic device being an inductor.

12. The portable electronic printing system as in claim 9, said second electronic device being a toroidal coil.

13. The portable electronic printing system as in claim 9, further comprising an additional sidewall, said bracket being coupled to said additional sidewall such that at least some heat received by said bracket from said first electronic device is transferred to said additional sidewall.

* * * * *